US010408017B2

(12) United States Patent
Kumar et al.

(10) Patent No.: US 10,408,017 B2
(45) Date of Patent: Sep. 10, 2019

(54) DOWNHOLE FLOW DEVICE

(71) Applicant: WELLTEC A/S, Allerød (DK)

(72) Inventors: Satish Kumar, Allerød (DK); Neil Hannah, Allerød (DK)

(73) Assignee: WELLTEC A/S, Allerød (DK)

( * ) Notice: Subject to any disclaimer, the term of this patent is extended or adjusted under 35 U.S.C. 154(b) by 205 days.

(21) Appl. No.: 15/285,950

(22) Filed: Oct. 5, 2016

(65) Prior Publication Data

US 2017/0096879 A1 Apr. 6, 2017

(30) Foreign Application Priority Data

Oct. 6, 2015 (EP) ..... 15188577

(51) Int. Cl.
*E21B 34/14* (2006.01)
*E21B 33/124* (2006.01)
(Continued)

(52) U.S. Cl.
CPC ..... *E21B 34/14* (2013.01); *E21B 23/00* (2013.01); *E21B 33/1243* (2013.01); *E21B 43/12* (2013.01); *E21B 2034/007* (2013.01)

(58) Field of Classification Search
CPC . E21B 34/14; E21B 2034/007; E21B 33/1243
See application file for complete search history.

(56) References Cited

U.S. PATENT DOCUMENTS 2,248,305 A * 7/1941 Rasmussen ..... E21B 34/14 137/613
5,156,220 A * 10/1992 Forehand ..... E21B 33/1208 166/332.7
5,316,084 A * 5/1994 Murray ..... E21B 33/1208 166/332.4
6,722,439 B2 * 4/2004 Garay ..... E21B 34/06 166/373
(Continued)

FOREIGN PATENT DOCUMENTS

EP 1 999 337 10/2009
EP 2 778 339 9/2014

OTHER PUBLICATIONS

Extended Search Report for EP 15188557.1, dated Mar. 24, 2016, 9 pages.

*Primary Examiner* — Blake E Michener
(74) *Attorney, Agent, or Firm* — Nixon & Vanderhye P.C.

(57) ABSTRACT

The present invention relates to a downhole flow device for controlling a flow of fluid between an annulus and an inner bore of a well tubular metal structure arranged in a borehole. The downhole flow device comprises a tubular part comprising a first opening and an axial extension, and a sliding sleeve configured to slide within the tubular part between a first position covering the opening and a second position fully uncovering the opening, the tubular part comprising a first groove and a second groove, the first groove being arranged at a first distance from the second groove along the axial extension, and the sliding sleeve comprising a projecting part configured to engage the first groove in the first position and the second groove in the second position, wherein the tubular part comprises a third groove configured to be engaged by the projecting part and having a second distance to the second groove which is smaller than the first distance. The present invention furthermore relates to a downhole system for controlling a flow of fluid in a well downhole and to a downhole manipulation method for shifting a position of the downhole flow device of a downhole system.

17 Claims, 12 Drawing Sheets

(51) Int. Cl.

| | |
|---|---|
| ***E21B 23/00*** | (2006.01) |
| ***E21B 43/12*** | (2006.01) |
| ***E21B 34/00*** | (2006.01) |

(56) References Cited

U.S. PATENT DOCUMENTS

| | | | | |
|---|---|---|---|---|
| 7,363,981 | B2 * | 4/2008 | Coon | E21B 34/14 166/332.1 |
| 7,921,915 | B2 * | 4/2011 | Richard | E21B 34/14 166/334.4 |
| 2003/0127232 | A1 | 7/2003 | Bussear et al. | |
| 2003/0183392 | A1 * | 10/2003 | Garay | E21B 34/06 166/320 |
| 2008/0236819 | A1 | 10/2008 | Foster et al. | |
| 2008/0302533 | A1 * | 12/2008 | Richard | E21B 34/14 166/316 |
| 2011/0297254 | A1 | 12/2011 | Geddes et al. | |
| 2014/0216755 | A1 * | 8/2014 | Hallunæk | E21B 23/06 166/373 |
| 2015/0159469 | A1 * | 6/2015 | Purkis | E21B 23/04 166/373 |
| 2016/0032670 | A1 * | 2/2016 | Webster | E21B 23/004 166/381 |
| 2016/0040508 | A1 * | 2/2016 | Webster | E21B 21/103 166/244.1 |
| 2016/0130910 | A1 * | 5/2016 | Gonzalez | E21B 23/006 |

* cited by examiner

DOWNHOLE FLOW DEVICE

This application claims priority to EP Patent Application No. 15188557.1, filed 6 Oct. 2015, the entire contents of which is hereby incorporated by reference.

FIELD OF THE INVENTION

The present invention relates to a downhole flow device for controlling a flow of fluid between an annulus and an inner bore of a well tubular metal structure arranged in a borehole, comprising a tubular part comprising a first opening and an axial extension, and a sliding sleeve configured to slide within the tubular part between a first position covering the opening and a second position uncovering the opening. The present invention furthermore relates to a downhole system for controlling a flow of fluid in a well downhole and to a downhole manipulation method for shifting a position of the downhole flow device of a downhole system.

BACKGROUND ART

During manipulation of sliding sleeves from a closed position to another position, it is difficult to verify the actual position of the sliding sleeve, and a subsequent tool, such as a logging tool, needs to be run into the well to verify the position of the sliding sleeve and thus verify if the sliding sleeve has actually been moved. Also, opening/closing binary valves exist, but multi-position valves that could be operated reliably with intervention have never been commercially deployed. Some known multi-position valves require multiple tools to shift multiple valves to varied positions.

SUMMARY OF THE INVENTION

It is an object of the present invention to wholly or partly overcome the above disadvantages and drawbacks of the prior art. More specifically, it is an object to provide an improved downhole flow device whose actual position is easy to control and verify without having to use a logging tool in a subsequent run.

The above objects, together with numerous other objects, advantages and features, which will become evident from the below description, are accomplished by a solution in accordance with the present invention by a downhole flow device for controlling a flow of fluid between an annulus and an inner bore of a well tubular metal structure arranged in a borehole, comprising:

- a tubular part comprising a first opening and an axial extension, and
- a sliding sleeve configured to slide within the tubular part between a first position covering the opening and a second position uncovering the opening, the tubular part comprising a first groove and a second groove, the first groove being arranged at a first distance from the second groove along the axial extension, and the sliding sleeve comprising a projecting part configured to engage the first groove in the first position and the second groove in the second position, wherein the tubular part comprises a third groove configured to be engaged by the projecting part and having a second distance to the second groove which is smaller than the first distance.

The present invention further relates to a downhole flow device for controlling a flow of fluid between an annulus and an inner bore of a well tubular metal structure arranged in a borehole, comprising a tubular part having an axial extension and comprising a first opening and a second opening, the first opening being arranged at an opening distance from the second opening along the axial extension; and a sliding sleeve configured to slide within the tubular part between a first position covering the opening and a second position uncovering at least one of the openings, the tubular part comprising a first groove in which the sliding sleeve slides, and the tubular part comprising a second groove and a third groove, the second groove being arranged at a second distance from the third groove along the axial extension, said second distance being smaller than the opening distance, and the sliding sleeve comprising a projecting part configured to engage the first groove or the second groove in the second position.

Also, the projecting part may be a retractable projection part.

Additionally, the projecting part may be compressible.

Furthermore, the projecting part may be made of spring steel.

In addition, the projecting part may be movable between a projected position and a retracted position.

The projecting part may have an intermediate retracted position.

Further, the projecting part may have the intermediate retracted position between the first position and the second position.

Also, the downhole flow device may comprise several positions, i.e. be a multi-position valve.

In another aspect, the downhole flow device may comprise several openings along the same plane perpendicular to the axial extension.

Furthermore, the openings may vary in size.

In addition, the projecting part may be projected by means of a spring or hydraulic fluid acting on the projecting part.

Moreover, the projecting part may have a retracted position and a projected position, and in the projected position, the projecting part may be configured to engage one of the grooves.

Also, in the retracted position, the sliding sleeve may have an outer diameter corresponding to the inner diameter of the tubular part.

Additionally, the sliding sleeve may comprise an outer face and a sealing element, the sealing element being arranged on the outer face configured to seal against an inner face of the tubular part.

Moreover, the tubular part may comprise a second opening displaced from the first opening in the axial extension.

Furthermore, the tubular part may comprise a plurality of openings.

Also, the first opening and the second opening may be displaced from the grooves along the axial extension.

In addition, the sliding sleeve may comprise grooves configured to be engaged by a downhole manipulation tool.

Moreover, the second groove and the third groove may constitute a set of grooves, one of the grooves being an indication groove and the other groove being a locking groove.

Additionally, the second groove and the third groove may constitute a set of grooves and the tubular part may comprise a plurality of sets of grooves.

Further, the second groove and the third groove may constitute a set of grooves in that the second groove and the third groove may have a mutual distance being smaller than the distance between the first groove and the second groove.

In addition, the set of grooves may comprise more than two grooves, e.g. at least three or four grooves.

In another aspect, each set of grooves may comprise a different number of grooves.

Furthermore, the sliding sleeve may comprise a plurality of projecting parts.

Also, the tubular part may comprise a groove in which the sliding sleeve slides.

In addition, the sliding sleeve may have an inner diameter which is substantially equal to the inner diameter of the well tubular metal structure.

Also, the grooves of the tubular part may comprise inclined end faces.

Furthermore, the projecting part may comprise at least one inclined face.

The downhole flow device according to the present invention may further comprise an insert arranged in the opening.

Said insert may be fastened in the opening by means of a fastening element, such as a snap ring.

The snap ring may engage an indentation in the opening.

Further, the insert may be made of a ceramic material.

In addition, the snap ring may be made of steel, such a spring steel.

Moreover, the inclined face of the projecting part may be configured to slide along the inclined end face of the grooves.

Also, the sliding sleeve may be made of metal.

In addition, the projecting part may be made of metal.

Additionally, the tubular part may be made of metal.

The present invention furthermore relates to a downhole system for controlling a flow of fluid in a well downhole, comprising:

- a well tubular metal structure arranged in a borehole,
- a downhole flow device as described above,
- a downhole manipulation tool configured to move the sliding sleeve along the axial extension, and
- a power supply configured to power an operation of the downhole manipulation tool.

The downhole system may further comprise a power read out unit configured to detect the power used by the downhole manipulation tool.

Also, the downhole manipulation tool may comprise a stroking tool section configured to provide an axial force along the axial extension.

Additionally, the stroking tool section may provide an axial force in an axial direction of a downhole tool and comprise a pump; a driving unit for driving the pump; and an axial force generator comprising an elongated piston housing having a first end and a second end; and a piston provided on a shaft, the shaft penetrating the housing to transmit the axial force to another tool, wherein the piston is provided in the piston housing so that the shaft penetrates the piston and each end of the piston housing and divides the housing into a first chamber and a second chamber, and wherein the first chamber is fluidly connected to the pump via a duct and the second chamber is fluidly connected to the pump via another duct so that the pump can pump fluid into one chamber by sucking fluid from the other chamber to move the piston within the housing and thereby move the shaft back and forth.

Moreover, the stroking tool section may provide an axial force in an axial direction of a downhole tool and comprise a housing; a first chamber; a first tool part comprising a pump unit providing pressurised fluid to the chamber; a shaft penetrating the chamber; and a first piston dividing the first chamber into a first chamber section and a second chamber section, wherein the piston is connected to or forms part of the housing which forms part of a second tool part and the piston is slidable in relation to the shaft so that the housing moves in relation to the shaft, the shaft being stationary in relation to the pump unit during pressurisation of the first chamber section or the second chamber section, generating a pressure on the piston, wherein the shaft is fixedly connected to the first tool part, and wherein the housing is slidable in relation to the first tool part and overlaps the first tool part.

Furthermore, the stroking tool section may comprise at least one projecting unit, such as a key.

Also, the downhole manipulation tool may comprise an anchoring section configured to anchor the downhole manipulation tool along the axial extension.

Moreover, the stroking tool section may be configured to provide an upstroke and a downstroke.

In addition, the anchoring section may be a driving unit, such as a downhole tractor.

Additionally, the downhole manipulation tool may further comprise a detection unit, such as a casing collar locator or a magnetic profiling unit for locating a position of the downhole manipulation tool along the well tubular metal structure.

The downhole system according to the present invention may further comprise a storage unit.

Moreover, the storage unit may be arranged in the downhole manipulation tool.

Furthermore, the storage unit may be arranged at a top of the well.

The downhole system may further comprise a communication unit.

In addition, the well tubular metal structure may comprise two annular barriers, each annular barrier comprising a tubular part mounted as part of the first well tubular metal structure; an expandable tubular surrounding the tubular part, each end section of the expandable tubular being connected with the tubular part; an annular barrier space between the tubular part and the expandable tubular; and an expansion opening in the tubular part through which pressurised fluid passes for expanding the expandable tubular and bringing the annular barrier from an unexpanded position to an expanded position.

Furthermore, the downhole flow device may be arranged between the two annular barriers.

In addition, the downhole system may comprise more than two annular barriers.

Also, the downhole system may comprise more downhole flow devices.

The present invention furthermore relates to a downhole manipulation method for shifting a position of a downhole flow device of a downhole system as described above, comprising:

- arranging the tool in engagement with the sliding sleeve,
- moving the sliding sleeve along the axial extension until the projecting part of the sliding sleeve engages the second groove, and
- forcing the projecting part out of engagement with the second groove by moving the sliding sleeve further along the axial extension towards engagement with the third groove.

The downhole manipulation method may further comprise reading the power used by the downhole manipulation tool during movement of the sliding sleeve; and detecting that an increased amount of power is used for verifying that the projecting part has disengaged the second groove.

Finally, the downhole manipulation method may further comprise moving the sliding sleeve in a direction opposite the movement moving the sliding sleeve from the second groove to the third groove.

BRIEF DESCRIPTION OF THE DRAWINGS

The invention and its many advantages will be described in more detail below with reference to the accompanying schematic drawings, which for the purpose of illustration show some non-limiting embodiments and in which.

All the figures are highly schematic and not necessarily to scale, and they show only those parts which are necessary in order to elucidate the invention, other parts being omitted or merely suggested.

DETAILED DESCRIPTION OF THE INVENTION

Figure 1:
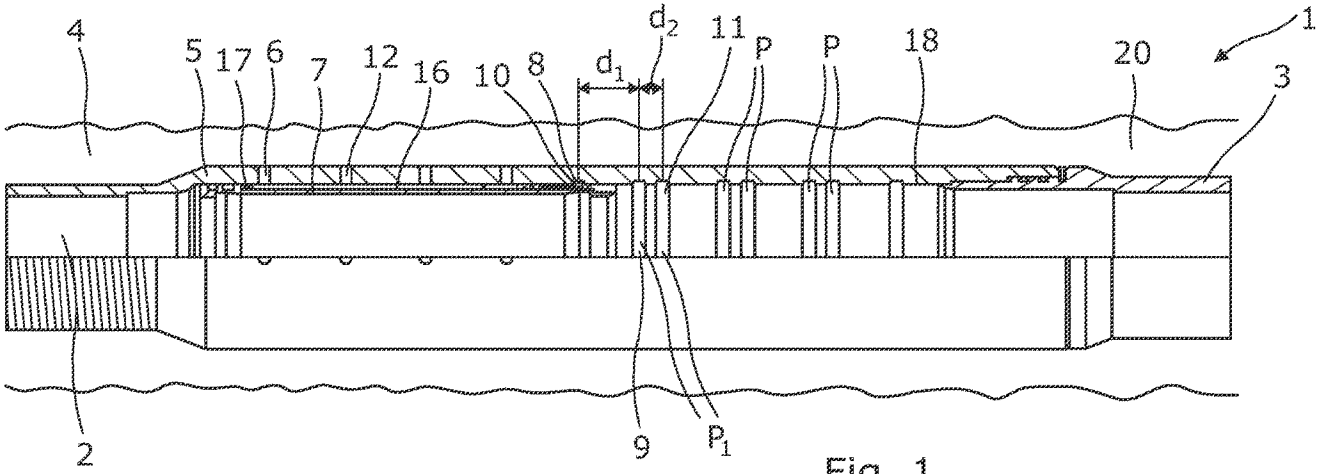
FIG. 1 shows a cross-sectional view of a downhole flow device in a closed position.

FIG. 1 shows a downhole flow device 1 for controlling a flow of fluid between an annulus 20 and an inner bore 2 of a well tubular metal structure 3 arranged in a borehole 4 for producing hydrocarbon-containing fluid from a reservoir. The downhole flow device 1 comprises a tubular part 5 having a first opening 6 for allowing the fluid to flow into the downhole flow device. The downhole flow device further comprises a sliding sleeve 7 configured to slide within the tubular part 5 between a first position covering the opening, as shown in FIG. 1, and a second position fully uncovering the opening to prevent the fluid from flowing into the downhole flow device 1, as shown in FIG. 1. The tubular part 5 comprises a first groove 8 and a second groove 9, the first groove being arranged at a first distance $d_1$ from the second groove along the axial extension. The sliding sleeve 7 comprises a projecting part 10 configured to engage the first groove 8 in the first position and the second groove 9 in the second position. The tubular part 5 comprises a third groove 11 also configured to be engaged by the projecting part 10, and the third groove 11 has a second distance $d_2$ to the second groove 9 which is smaller than the first distance $d_1$, as shown in FIG. 1. By having the second groove 9 and the third groove 11 arranged close to each other, the projecting part 10 after engaging the first groove and moving further in the same direction needs to be pressed inwards, which requires a significantly higher amount of power by a downhole manipulation tool moving the sliding sleeve 7. Thus, it can be verified that the sleeve 7 is in fact in the second position uncovering the first opening. This is due to the fact that the second groove 9 functions as an indication groove in that when the projecting part leaves the second groove, the power demand increases significantly, indicating that the projecting part 10 has left the second groove. The third groove 11 functions as a locking groove. When moving the sliding sleeve 7 in the opposite direction, the third groove 11 is the indication groove and the second groove is the locking groove.

When pulling the sliding sleeve 7, it is difficult to verify the position of the sliding sleeve just by the tool performing the sliding movement of the sliding sleeve. Then, a subsequent tool, such as a logging tool, needs to be run into the well to verify the position of the sliding sleeve 7 and thus verify if the sliding sleeve has actually been moved. By the present solution, the position of the sliding sleeve 7 can be verified by looking at the power demand of the tool performing the sliding movement of the sliding sleeve. Thus, by looking at the current demand illustrated in FIG. 13 and counting the peaks of the curve, the operator can verify the position of the sliding sleeve.

Figure 2:
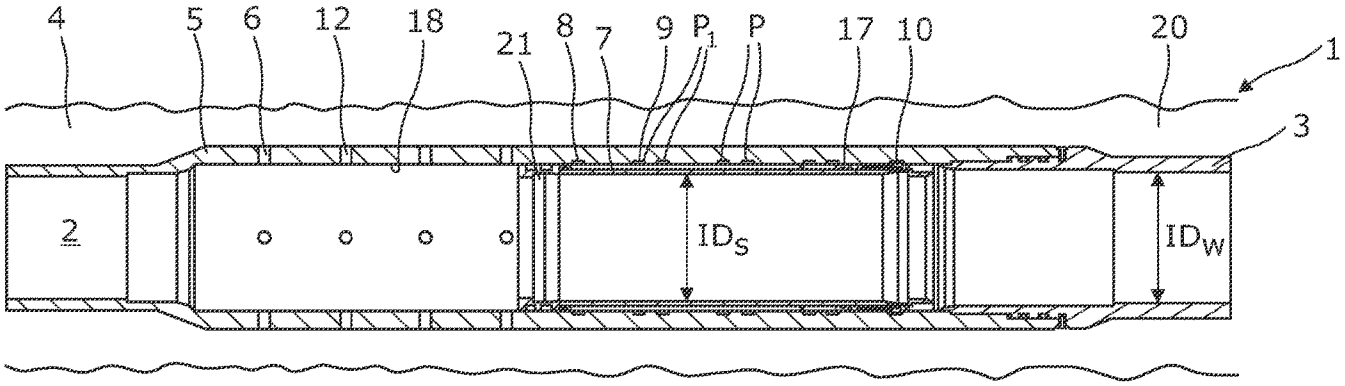
FIG. 2 shows a cross-sectional view of the downhole flow device of FIG. 1 in a fully open position.

The downhole flow device 1 of FIGS. 1 and 2 comprises several openings along the axial extension and is thus a multi-position valve. The downhole flow device 1 also comprises several openings arranged in the same circumferential plane perpendicular to the axial extension.

Figure 3:
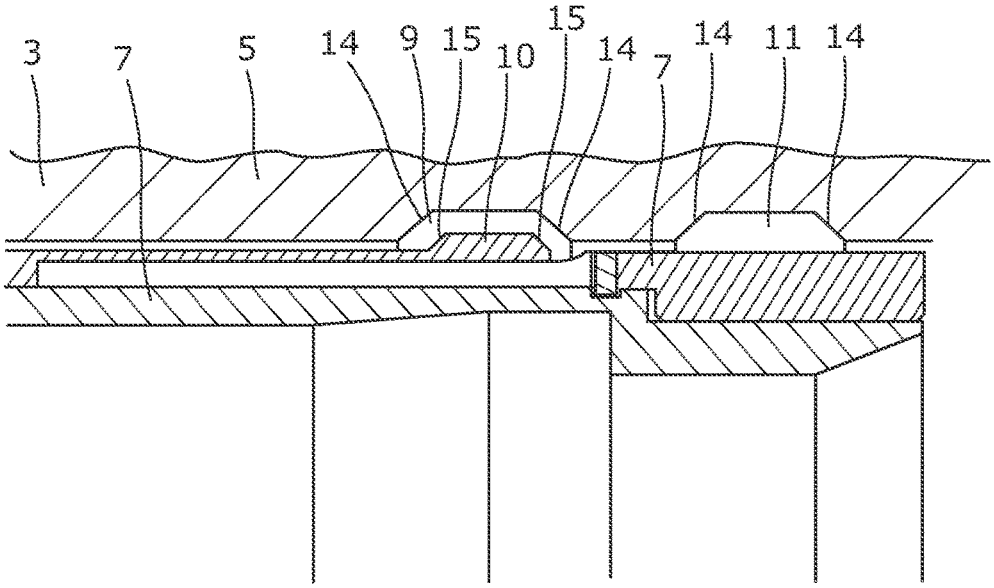
FIG. 3 shows a partial view of the downhole flow device of FIGS. 1 and 2 in which the projecting part engages a groove.

In FIG. 3, the projecting part 10 is in a projected position in which the projecting part engages the second groove 9. The projecting part 10 is a retractable projection part, and in FIG. 4, the projecting part 10 is in a retracted position and squeezed inwards by the part of the tubular part 5 arranged between the grooves, and the sliding sleeve 7 has an outer diameter corresponding to the inner diameter of the tubular part 5 opposite the groove. The projecting part 10 is made of spring steel or a similar material. In another aspect of the invention, the projecting part 10 may be projected by means of a spring or hydraulic fluid acting on the projecting part. As shown in FIG. 1, the sliding sleeve 7 comprises an outer face 16 and a sealing element 17 arranged on the outer face of the sleeve and configured to seal against an inner face 18 of the tubular part 5.

As can be seen in FIG. 2, the tubular part 5 comprises a second opening 12 and other openings displaced from the first opening in the axial extension. The openings in the tubular part 5 are displaced from the grooves along the axial extension so that the sliding sleeve 7 covers all openings when the projecting part 10 engages the first groove 8. When moving the sliding sleeve 7 so that the projecting part 10 of the sliding sleeve engages the first groove 8 in a first set P, $P_1$ of grooves, the sliding sleeve 7 uncovers the first openings 6 arranged along the same circumferential plane of the tubular part 5.

If the sleeve has several positions, more sets of grooves are arranged along the axial extension of the tubular part, and the first groove of each set functions as an indication groove in that when the projecting part leaves that groove, it is an indication of a significantly higher power demand of the tool performing the movement. When moving the sliding sleeve in the opposite direction, the third groove is the indication groove and the second groove is the locking groove.

Figure 5:
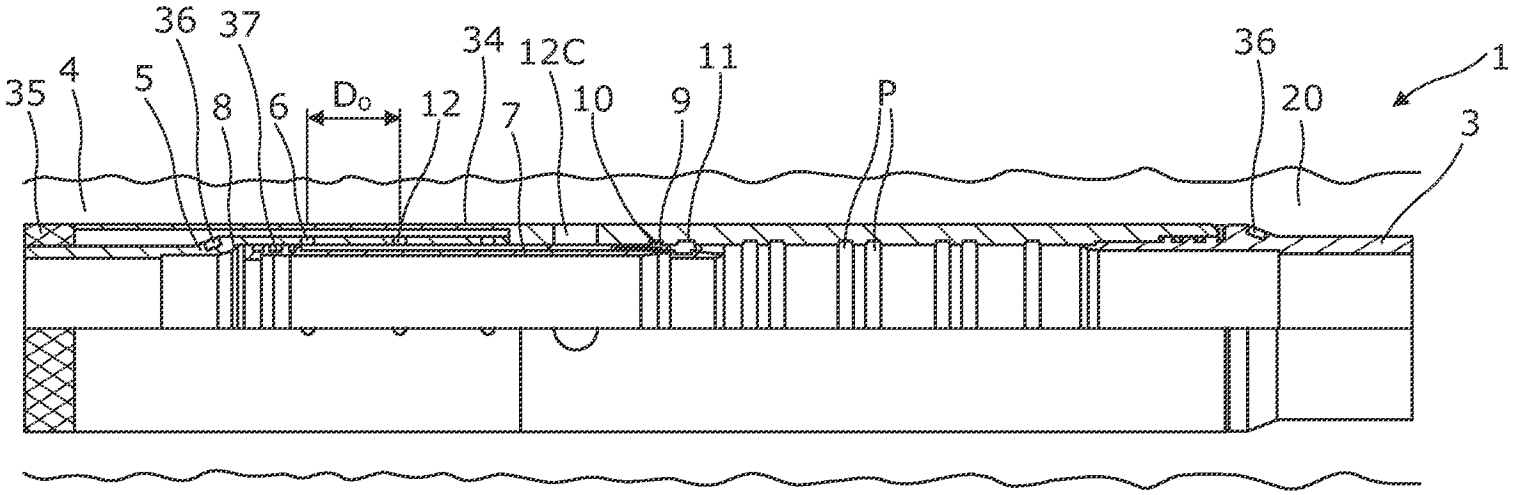
FIG. 5 shows a cross-sectional view of another downhole flow device in a closed position.

In FIG. 5, the downhole flow device 1 comprises a tubular part 5 comprising the first opening 6 and the second opening 12, the first opening being arranged at an opening distance $D_o$ from the second opening along the axial extension. The sliding sleeve 7 is in the same way configured to slide within the tubular part 5 between a first position covering the opening and a second position uncovering at least one of the openings. The tubular part 5 comprises the first groove 8 in which the sliding sleeve 7 slides, and the tubular part further comprises a second groove 9 and a third groove 11, the second groove being arranged at a second distance $d_2$ from the third groove (shown in FIG. 1) along the axial extension which is smaller than the opening distance, and the sliding sleeve comprises a projecting part 10 configured to engage the first groove or the second groove in the second position. Thus, the first groove 8 is the main groove in which the second groove 9 and the third groove 11 are arranged, and the second groove and the third groove constitute a set P of grooves.

Figure 14:
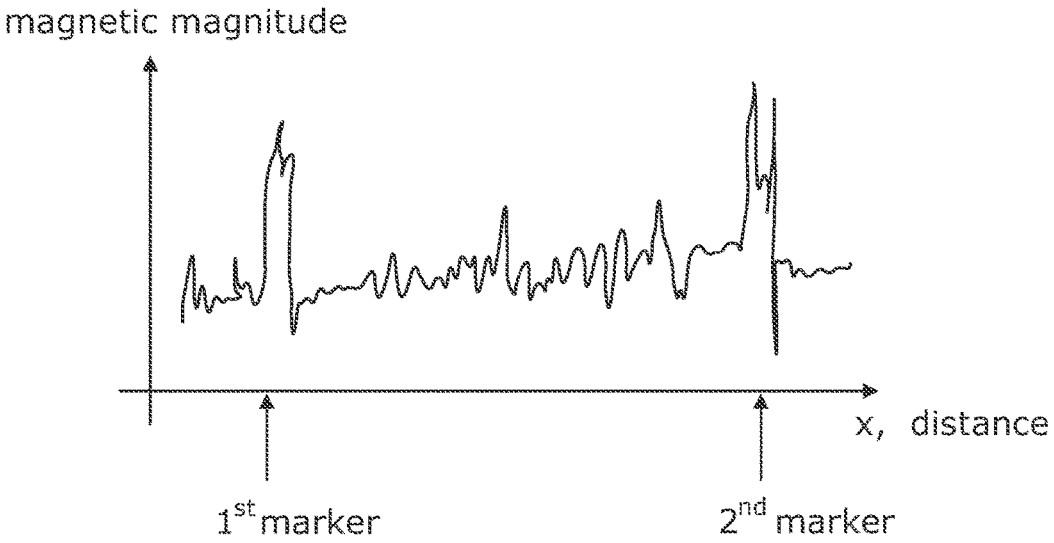
FIG. 14 shows a diagram of the magnetic magnitude measured to identify the marker distance and thus the position of the valve.

Furthermore, the downhole flow device 1 of FIG. 5 comprises a shroud 34 and a screen 35, allowing fluid from the reservoir to enter through the screen and flow under the shroud to the openings 6, 12. The openings 12C arranged closest to the sliding sleeve 7 have a substantially larger diameter and may be used for other purposes or just opened, if the flow of fluid through the smaller openings is not sufficient. The downhole flow device 1 comprises a first marker 36 arranged in the tubular part 5 and a second marker 37 arranged in the sliding sleeve 7. When detecting the position of the markers 36, 37, the position of the sliding sleeve 7, and thus the position of the downhole flow device 1, can be determined. The markers may be radioactive markers, such as PIP tags, magnetic coil wound around the tubular part 5 and/or the sliding sleeve 7, or just markers made of a magnetically different material than that of the tubular part 5 and the sliding sleeve 7. In FIG. 14, a detection unit has measured the magnetic magnitude by means of magnetometers where two peaks on the curve mark the two markers and the distance between them. The detection unit may be comprised in the downhole manipulation tool 40 (shown in FIG. 6).

Figure 6:
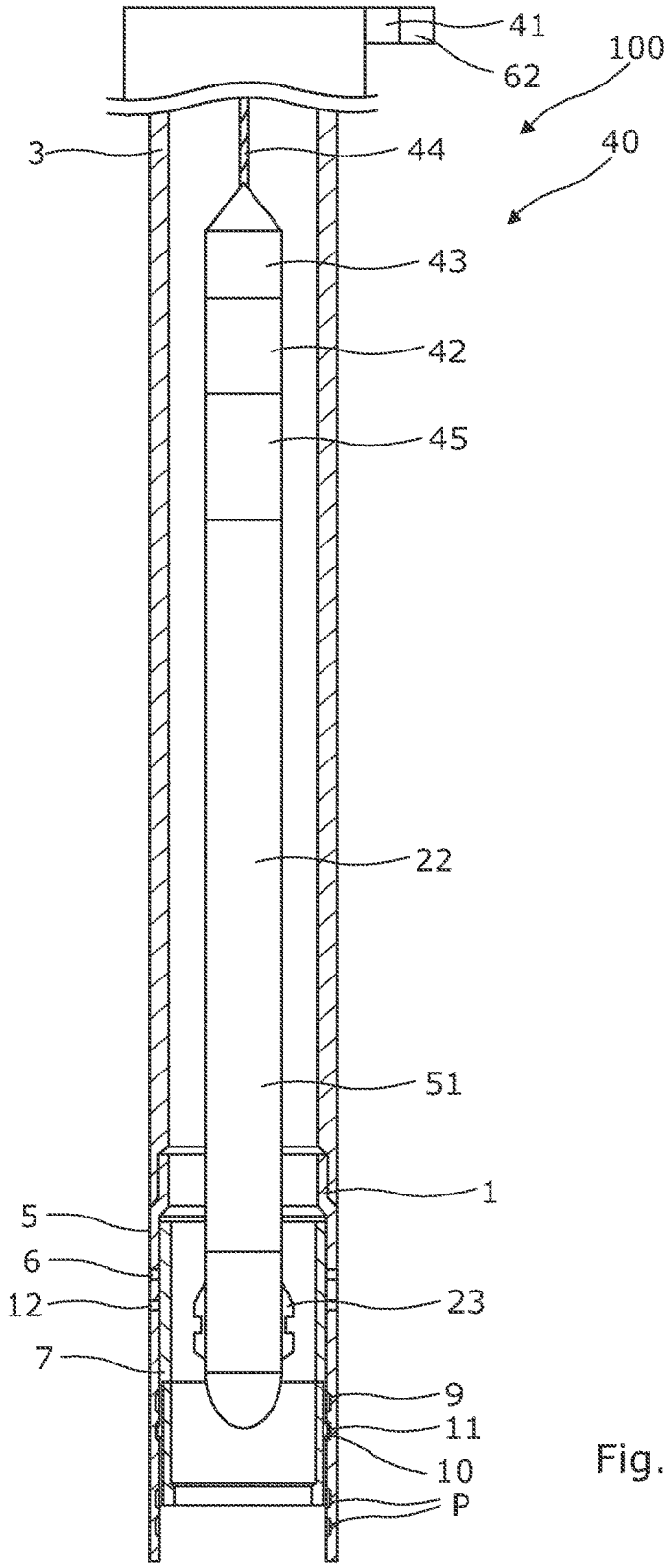
FIG. 6 shows a partial, cross-sectional view of a downhole system in which a manipulation tool is arranged opposite the downhole flow device.

As seen in FIG. 2, the sliding sleeve 7 comprises grooves 21 configured to be engaged by a downhole manipulation tool 40, as shown in FIG. 6. The sliding sleeve 7 comprises a plurality of projecting parts 10 distributed along the circumference of the sliding sleeve. In FIG. 2, the sliding sleeve 7 has an inner diameter $ID_s$ being substantially equal to the inner diameter $ID_W$ of the well tubular metal structure.

Figure 4:
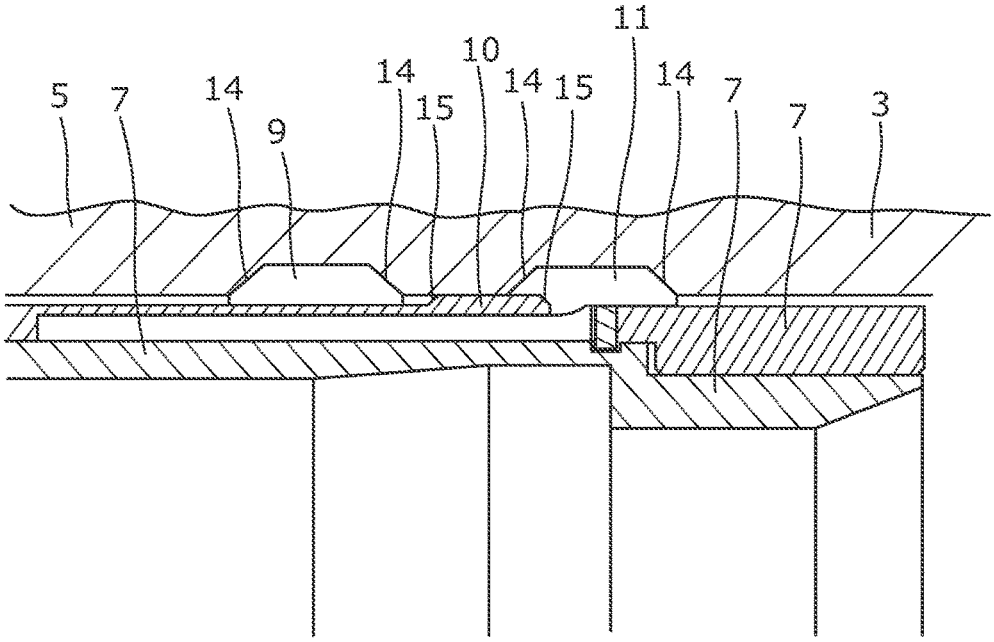
FIG. 4 shows a partial view of the downhole flow device of FIGS. 1 and 2 in which the projecting part is out of engagement.

The grooves of the tubular part 5 comprise inclined end faces 14, as shown in FIGS. 3 and 4, and the projecting part 10 comprises corresponding inclined faces 15 so that the projecting part is able to slide in and out of engagement with the grooves along the inclined end faces of the grooves. The sliding sleeve 7, the projecting part 10 and the tubular part 5 are made of metal so as to be able to withstand the force of the sliding sleeve being pulled back and forth several times by the manipulation tool.

FIG. 6 discloses a downhole system 100 for controlling a flow of fluid in a well downhole and in through the downhole flow device 1 mounted as part of a well tubular metal structure 3 arranged in a borehole. In order to move the sliding sleeve 7 from one position to another, the downhole system 100 further comprises a downhole manipulation tool 40 configured to slide the sliding sleeve along the axial extension. The downhole manipulation tool 40 is powered by a power supply 44, such as a wireline or a battery arranged in the tool. The downhole system 100 further comprises a power read out unit 41 configured to detect the power used by the downhole manipulation tool 40.

Figure 7:
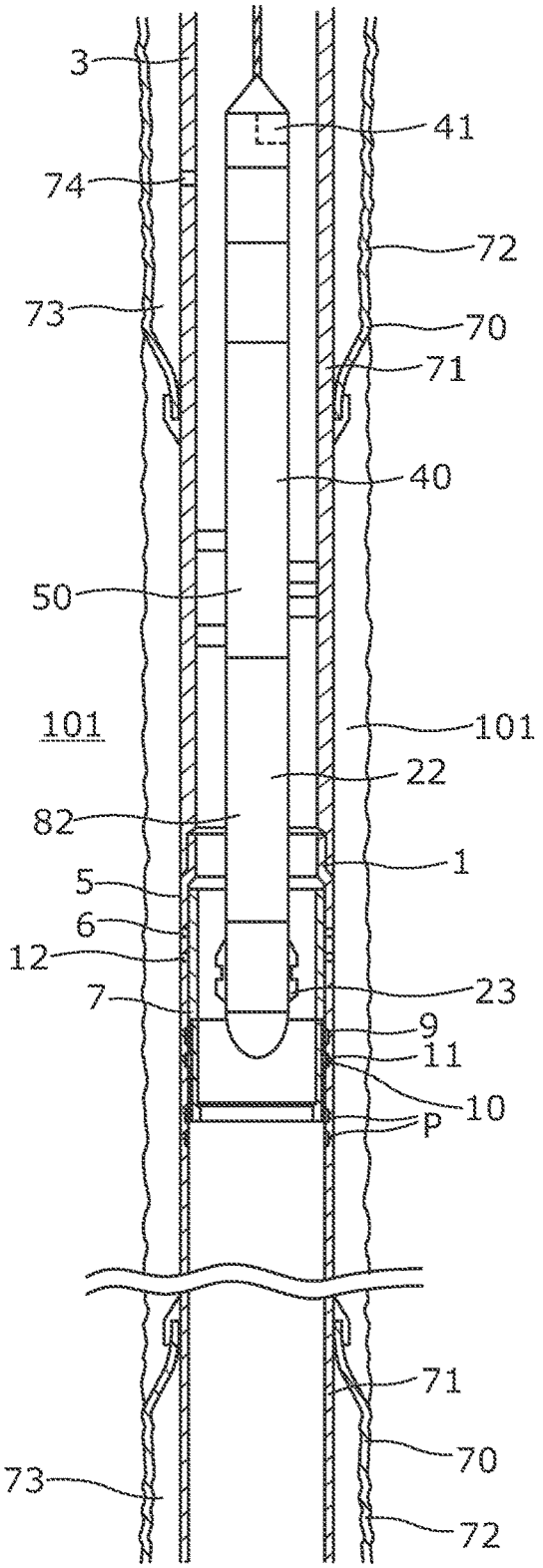
FIG. 7 shows a partial, cross-sectional view of another downhole system having annular barriers.
Figure 13:
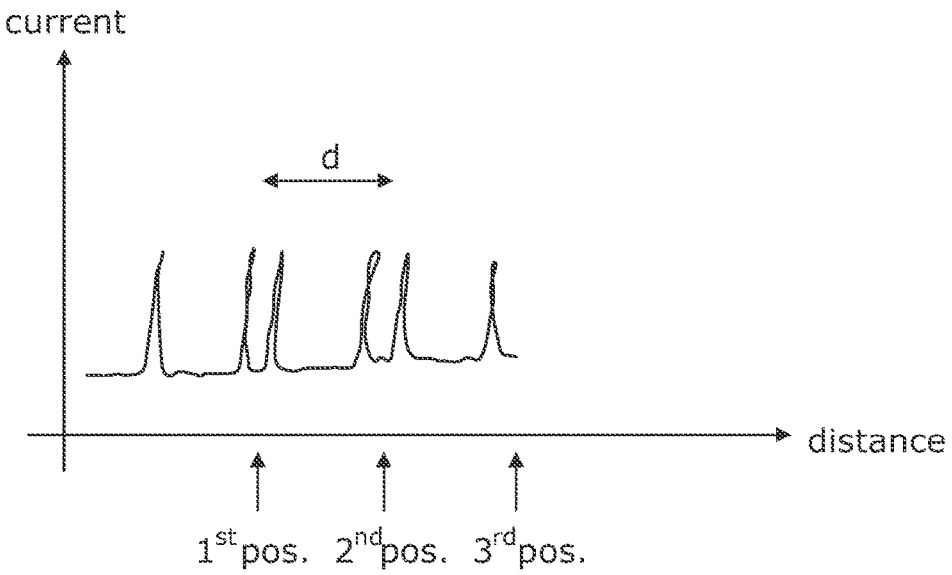
FIG. 13 shows a diagram of the current used during shifting of the valve from one position to another.

As shown in FIG. 7, the power read out unit 41 may also be arranged at the top of the well, and thus be a surface read out unit. A curve illustrating the power or current read out is shown in FIG. 13. The first peak of current indicates the current used when the projecting part leaves the first groove 8 (FIGS. 1 and 2), and the next two peaks indicate the current used for passing the second and the third grooves in order to reach the second position and further on to the third position. In the third position, there is only one peak since the projecting part of the sliding sleeve has not left the second groove of the set of grooves in the third position. The distance between the first position and the second position is the distance of one stroke of the downhole manipulation tool. In order to continue, the downhole manipulation tool is prepared for a new stroke. The sliding sleeve may also be manipulated from one position past another position to the next position in one stroke. However, by preparing the downhole manipulation tool to have a stroke distance corresponding to the distance between two opening positions, the sliding sleeve cannot easily be controlled from one position to the next without missing one. The downhole manipulation tool 40 comprises a stroking tool section 22 configured to provide an axial force along the axial extension to move the sliding sleeve 7. The stroking tool section 22 comprises at least one projecting unit 23, such a key, for engaging the groove in the sliding sleeve 7. Thus, the stroking tool section 22 is configured to provide an upstroke and a downstroke movement.

Figure 8:
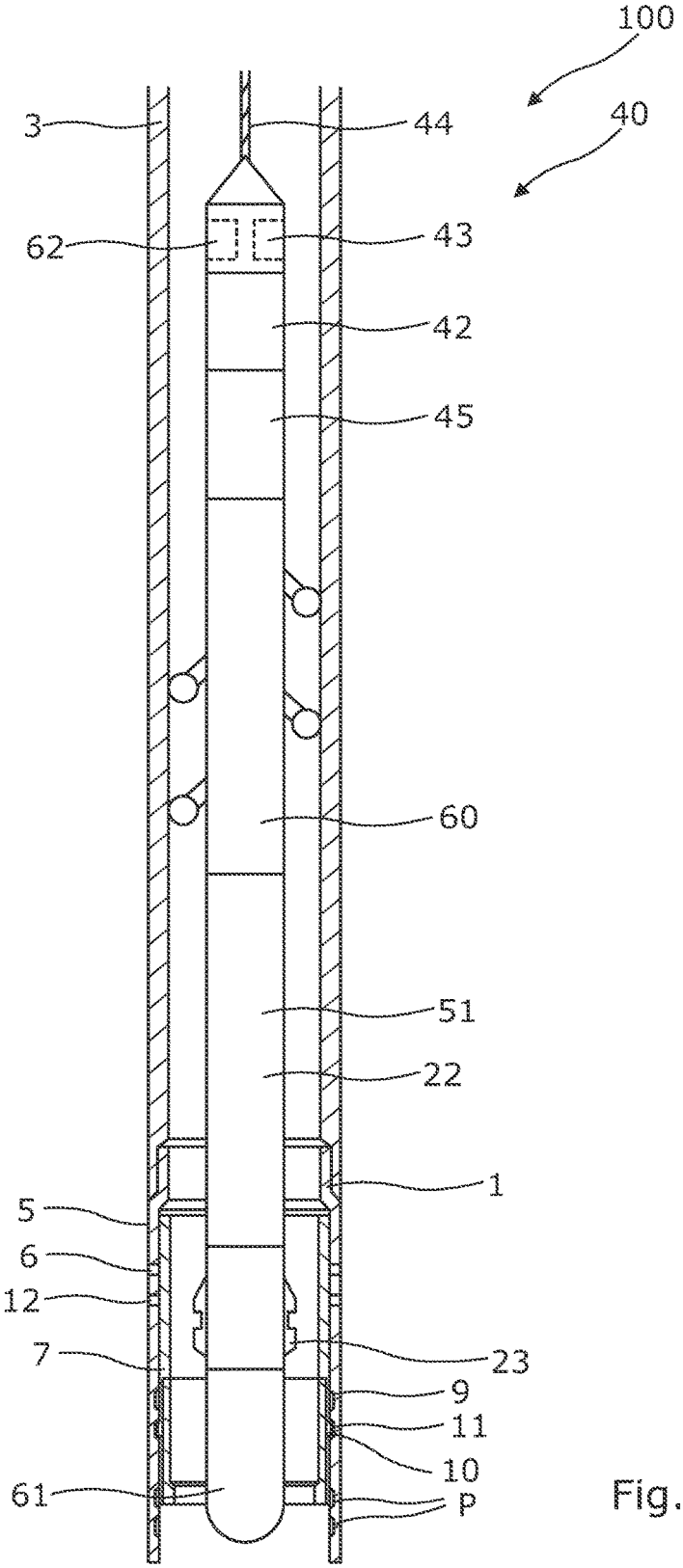
FIG. 8 shows a partial, cross-sectional view of yet another downhole system.

In FIG. 7, the downhole manipulation tool comprises an anchoring section 50 configured to anchor the downhole manipulation tool 40 along the axial extension. As shown in FIG. 8, the downhole manipulation tool 40 may also comprise a driving unit 60, such as a downhole tractor, which may function as the anchoring section. The downhole manipulation tool 40 further comprises a detection unit 61, such as a casing collar locator or a magnetic profiling unit, for detecting a position of the downhole manipulation tool along the well tubular metal structure 3.

The downhole system 100 further comprises a storage unit 62 arranged in the downhole manipulation tool 40, as shown in FIG. 8, or at the top of the well (shown in FIG. 6). The downhole manipulation tool 40 further comprises a communication unit 43 so as to be able to communicate with the tool from surface.

In FIG. 7, the well tubular metal structure 3 comprises two annular barriers 70 arranged on opposite sides of the downhole flow device 1 for providing a production zone 101 from which the hydrocarbon-containing fluid can flow from the production zone and in through the openings in the downhole flow device 1. Each annular barrier comprises a tubular part 71 which is mounted as part of the first well tubular metal structure 3 and an expandable tubular 72 surrounding the tubular part. Each end section of the expandable tubular is connected with the tubular part, defining an annular barrier space 73 between the tubular part and the expandable tubular. The tubular part comprises an expansion opening 74 through which pressurised fluid may pass to expand the expandable tubular and to bring the annular barrier from an unexpanded position to an expanded position.

In another aspect, the downhole system comprises more than two annular barriers and more downhole flow devices arranged between some of the annular barriers.

The manipulation tool 40 is arranged in engagement with the sliding sleeve 7 and moves the sliding sleeve along the axial extension until the projecting part 10 of the sliding sleeve engages the second groove 9. When moving the sliding sleeve further along the axial extension towards engagement with the third groove 11, the projecting part is forced out of engagement with the second groove. In this way, the downhole flow device 1 shifts position. In this direction of movement, the second groove is an indication groove. In order to verify that the position of the downhole flow device has shifted, the power used by the downhole manipulation tool during movement of the sliding sleeve is deducted, and if an increased power is used during the movement, it is verified that the projecting part has disengaged the second groove. When moving the sliding sleeve in an opposite direction by moving the sliding sleeve from the second groove to the third groove, the third groove functions as the indication groove.

Figure 9:
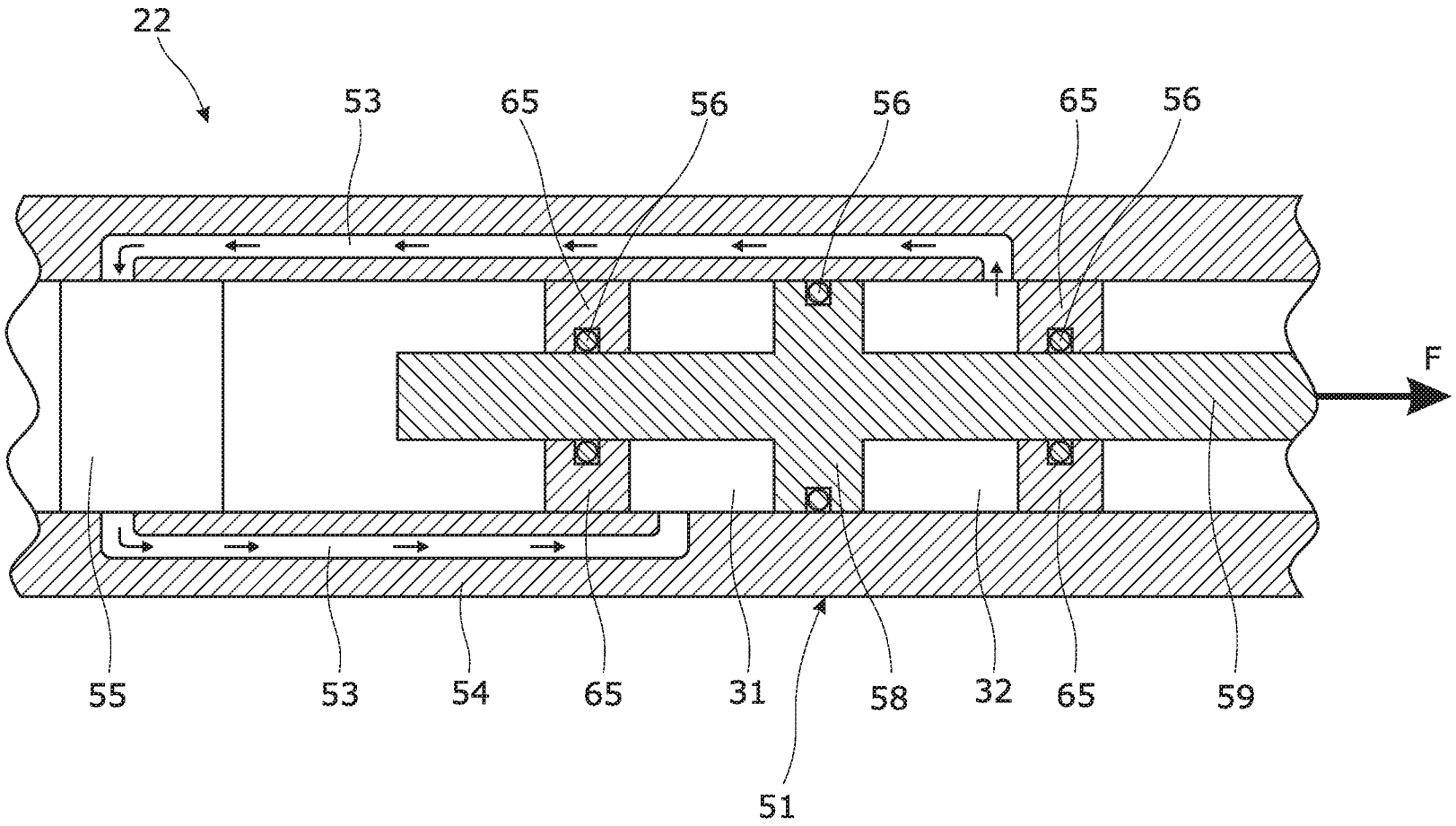
FIG. 9 shows a cross-sectional view of a stroking tool section.

In FIG. 8, the stroking tool section 22 is connected to a driving unit 60. The stroking tool section 22 is submerged into a well tubular metal structure 3 downhole via a wireline 44 through which a motor 42 is powered. The manipulation tool 40 further comprises a pump 45 driven by the motor for supplying pressurised fluid to drive the stroking tool section 22. In FIG. 9, the stroking tool section 22 comprises a piston housing 51 which is penetrated by a shaft 59. A piston 58 is provided around the shaft 59 so that the shaft 59 may run back and forth within the housing 51 to provide the axial force F. The piston 58 is provided with a sealing means 56 in order to provide a sealing connection between the inside of the piston housing 51 and the outside of the piston 58.

The piston housing 51 comprises a tube 54 which is closed by two rings 65 for defining the piston housing 51. The rings 65 have a sealing means 56, such as an O-ring, in order to provide a sealing connection between the rings 65 and the shaft 59. In this way, the piston housing 51 is divided into two chambers, namely a first chamber 31 and a second chamber 32. Each chamber is fluidly connected to a pump via ducts 53. In FIG. 9, the shaft 59 is projected as indicated by the arrow F, and the fluid direction is indicated by arrows in the ducts. When retracted, the fluid runs in the opposite direction.

Figure 10:
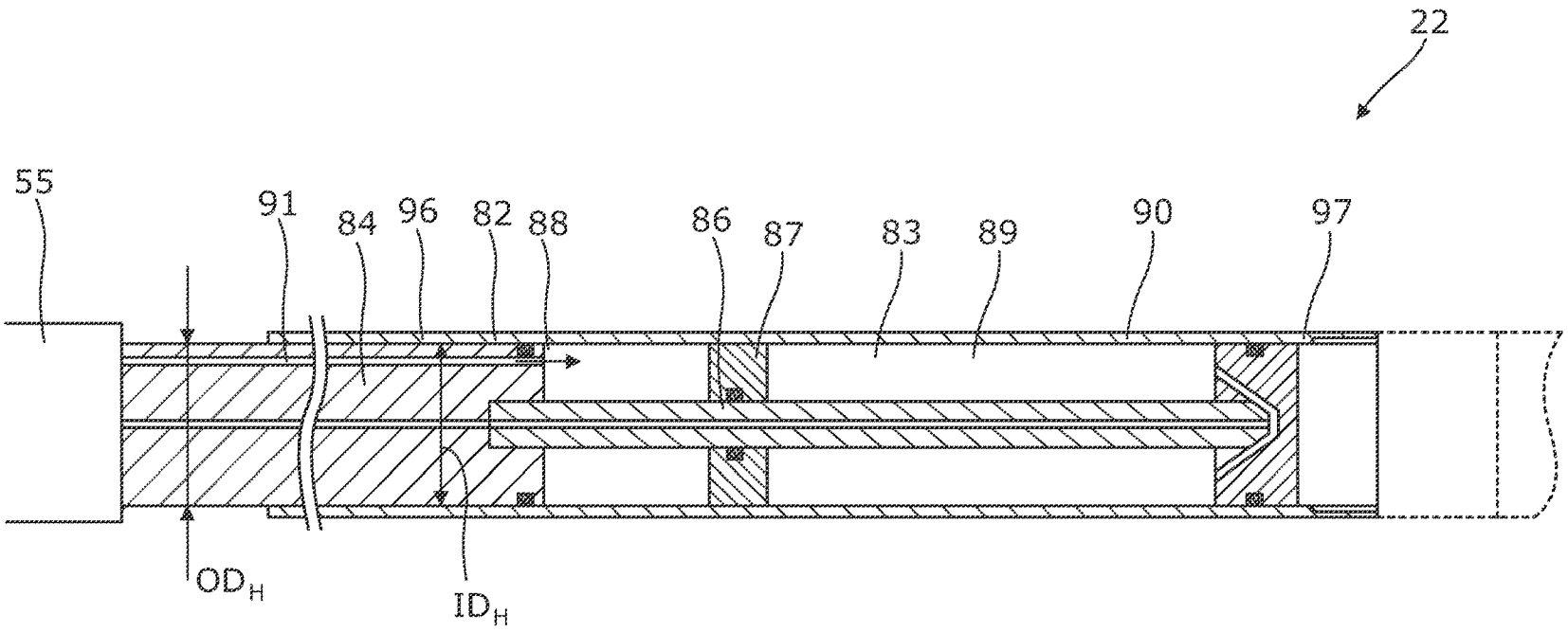
FIG. 10 shows a cross-sectional view of another stroking tool section.

FIG. 10 shows another stroking tool section 22 for providing an axial force in an axial direction of the manipulation tool, which is also the axial direction of the well tubular metal structure. The stroking tool section 22 comprises a housing 82, a first chamber inside the stroking tool section 22, and a first tool part 84 comprising a pump unit 55 for providing pressurised fluid to the chamber. The stroking tool section 22 comprises a shaft 86 penetrating the chamber 83 and a first piston 87 dividing the first chamber into a first chamber section 88 and a second chamber section 89. The piston 87 forms part of the housing which forms part of a second tool part 90. The second tool part 90, the housing 82 and the piston 87 are slidable in relation to the shaft 86 and the first tool part 84 so that the housing moves in relation to the shaft. The shaft is stationary in relation to the pump unit 55 during pressurisation of the first chamber section 88 or the second chamber section 89. The fluid is fed to one of the chamber sections through a fluid channel 91 in the first part and a fluid channel 91 in the shaft 86 for providing fluid to and/or from the chamber 83 during pressurisation of the first chamber section 88 or of the second chamber section 89, generating a pressure on the piston 87.

The pressurisation of the first chamber section generates a pressure on the piston and a downstroke in that the housing moves down away from the pump, as shown in FIG. 10. While fluid is led into the first chamber section 88, fluid is forced out of the second chamber section. When providing pressurised fluid into the second chamber section 89, a pressure is generated on the piston, providing an upstroke movement in that the housing moves from the position in FIG. 10 to the initial position and thus moves towards the pump. The shaft is fixedly connected with the first tool part, and the housing is slidable in relation to the first tool part and a first end part 96 of the housing overlaps the first tool part. When overlapping, the housing is supported partly by the first part, since the first part 84 has an outer diameter $OD_H$ which is substantially the same as an inner diameter $ID_H$ of the housing. The housing comprises a second end part 97 connected to the section having the keys.

In another embodiment, the tool is powered by a battery in the tool and is thus wireless. In another not shown embodiment, the pump may be powered by high pressured fluid from surface down through a pipe, coiled tubing, the well tubular metal structure or the casing.

Figure 11:
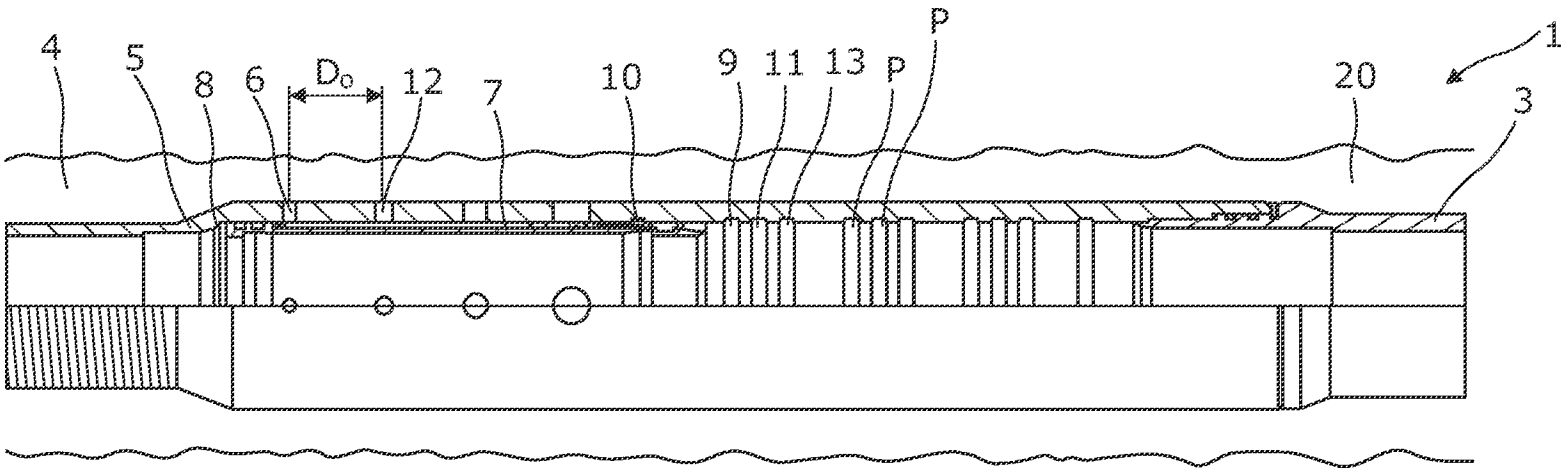
FIG. 11 shows a cross-sectional view of another downhole flow device in a closed position.

In FIG. 11, the downhole flow device 1 further comprises a fourth groove 13, meaning that one set of the grooves comprises three grooves, providing a further indication of the position of the sliding sleeve. The openings 6, 12 vary in size so that the first openings are the smallest while the openings closest to the sliding sleeve 7 are the largest. In this way, the downhole flow device 1 is not just a multi-position valve, but also a downhole flow device 1 where the amount of flow through the downhole flow device 1 may be varied when shifting from one position to the next.

Figure 12:
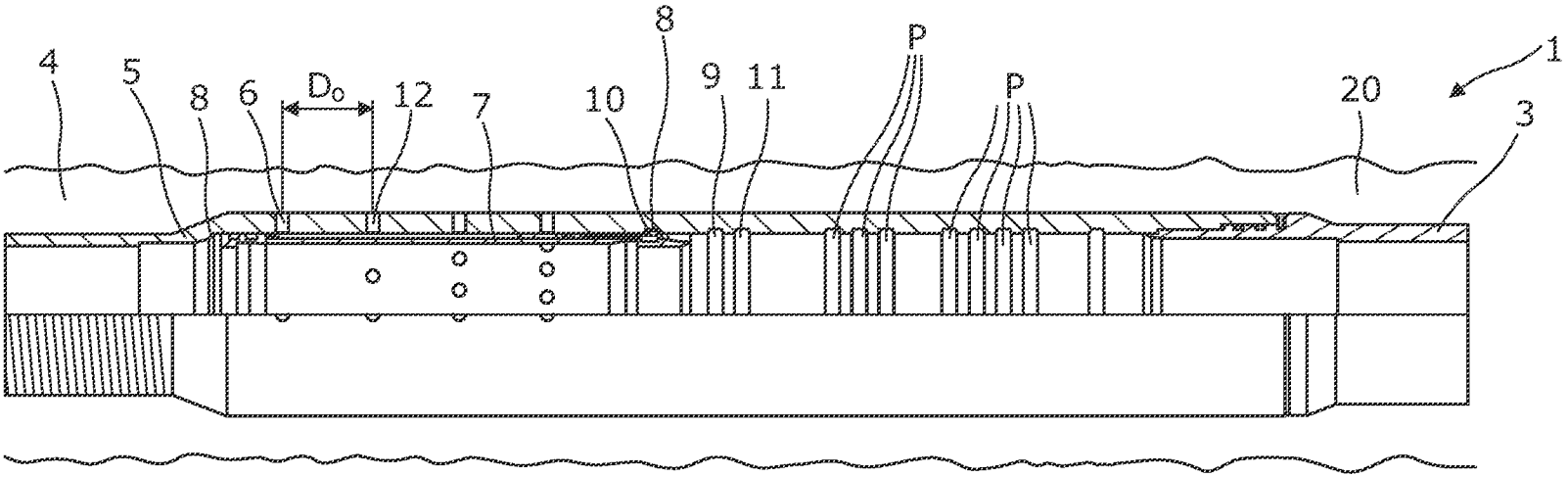
FIG. 12 shows a cross-sectional view of yet another downhole flow device in a closed position.

The downhole flow device 1 of FIG. 12 comprises a first groove 8, and the next grooves are the second groove 9 and the third groove 11 arranged in one set. The next set of grooves comprises three grooves, and the next set of grooves comprises four grooves. In this way, a further indication groove is given in order to verify the actual position of the sliding sleeve 7 and thus verify which openings are uncovered and which are covered by the sliding sleeve.

Figure 15A:
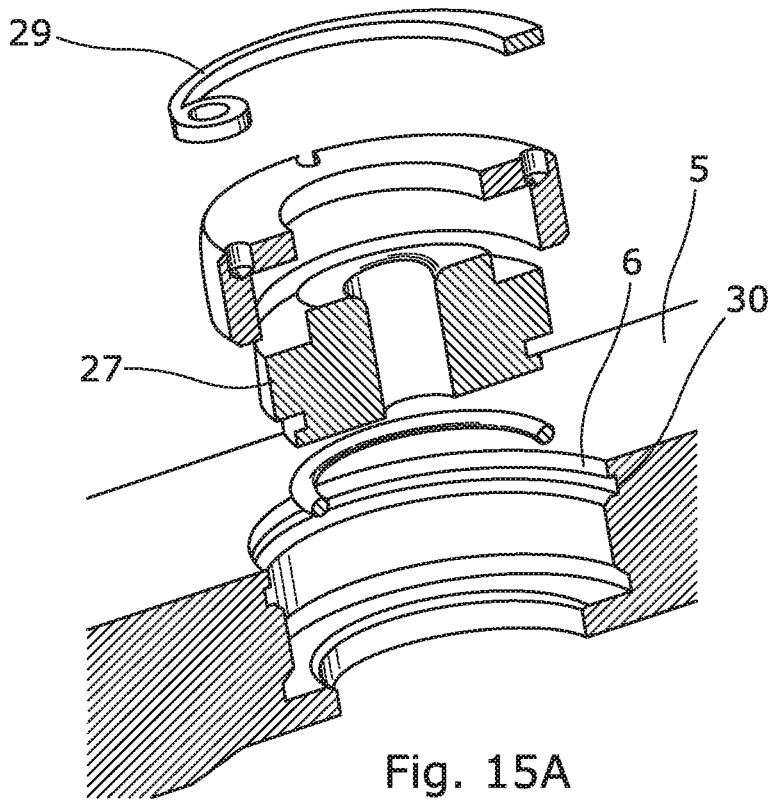
FIGS. 15A and 15B show a cross-sectional view of an insert arranged in the opening.
Figure 15B:
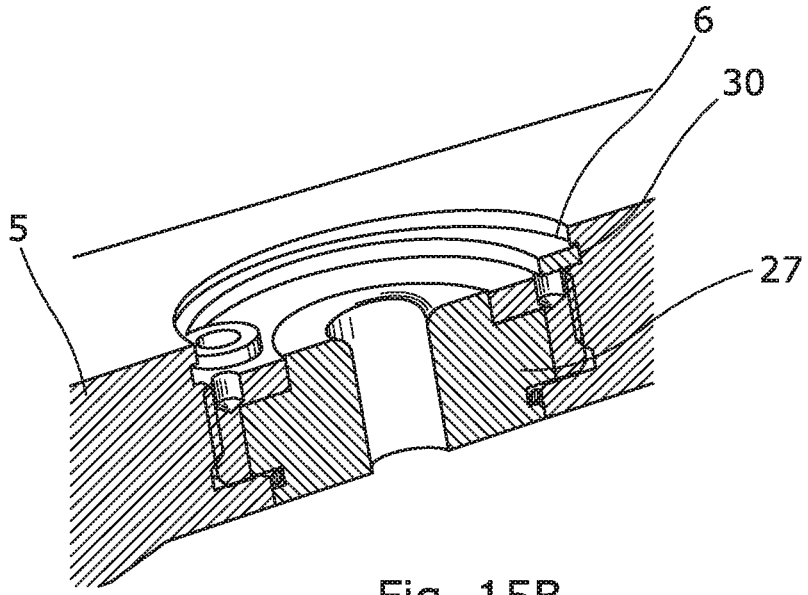

In FIGS. 15A and 15B, the downhole flow device further comprises an insert 27 arranged in the opening 6 of the tubular part 5. In FIG. 15A, the arrangement of the insert is in an exploded view, and in FIG. 15B the insert is fastened inside the opening. The insert is fastened in the opening by means of a fastening element 29, such as a snap ring 29. The snap ring 29 engages an indentation 30 in the opening. The insert is made of a ceramic material and has a pre-determined through-bore which is determined based on the parameters of the well, such as completion design, the borehole, the formation and/or the well fluid parameters, such as density, content, temperature and/or pressure. The snap ring is made of steel, such as spring steel.

By fluid or well fluid is meant any kind of fluid that may be present in oil or gas wells downhole, such as natural gas, oil, oil mud, crude oil, water, etc. By gas is meant any kind of gas composition present in a well, completion, or open hole, and by oil is meant any kind of oil composition, such as crude oil, an oil-containing fluid, etc. Gas, oil, and water fluids may thus all comprise other elements or substances than gas, oil, and/or water, respectively.

By a well tubular metal structure, production casing or casing is meant any kind of pipe, tubing, tubular, liner, string etc. used downhole in relation to oil or natural gas production.

In the event that the tool is not submergible all the way into the casing, a downhole tractor can be used to push the tool all the way into position in the well. The downhole tractor may have projectable arms having wheels, wherein the wheels contact the inner surface of the casing for propelling the tractor and the tool forward in the casing. A downhole tractor is any kind of driving tool capable of pushing or pulling tools in a well downhole, such as a Well Tractor®.

Although the invention has been described in the above in connection with preferred embodiments of the invention, it will be evident for a person skilled in the art that several modifications are conceivable without departing from the invention as defined by the following claims.

The invention claimed is:

1. A downhole flow device for controlling a flow of fluid between an annulus and an inner bore of a well tubular metal structure arranged in a borehole, comprising:

a tubular part comprising a first opening and an axial extension, and a sliding sleeve configured to slide within the tubular part between a first position covering the opening and a second position fully uncovering the opening, the tubular part comprising a first groove and a second groove, the first groove being arranged at a first distance from the second groove along the axial extension, and the sliding sleeve comprising a projecting part configured to engage the first groove in the first position and the second groove in the second position, wherein the tubular part comprises a third groove configured to be engaged by the projecting part and having a second distance to the second groove, which second distance is smaller than the first distance, and wherein the first distance corresponds to a first uninterrupted smooth surface extending from the first groove to the second groove, and wherein the second distance corresponds to a second uninterrupted smooth surface extending from the second groove to the third groove.

2. The downhole flow device according to claim 1, wherein the projecting part is a retractable projection part.

3. The downhole flow device according to claim 1, wherein the projecting part is movable between a projected position and a retracted position.

4. The downhole flow device according to claim 1, wherein the tubular part comprises a second opening displaced from the first opening in the axial extension.

5. The downhole flow device according to claim 1, wherein the second groove and the third groove constitute at least one set of grooves and the at least one set of grooves comprises a plurality of sets of grooves.

6. The downhole flow device according to claim 1, wherein the grooves of the tubular part comprise inclined end faces.

7. The downhole flow device according to claim 1, wherein the projecting part comprises at least one inclined face.

8. A downhole system for controlling a flow of fluid in a well downhole, comprising:

a well tubular metal structure arranged in a borehole, the downhole flow device according to claim 1, a downhole manipulation tool configured to engage and move the sliding sleeve along the axial extension on both upstroke and downstroke, and a power supply configured to power an operation of the downhole manipulation tool.

9. The downhole system according to claim 8, further comprising a power read out unit configured to detect the power used by the downhole manipulation tool.

10. The downhole system according to claim 8, wherein the downhole manipulation tool comprises a stroking tool section configured to provide an axial force along the axial extension.

11. The downhole system according to claim 8, further comprising a storage unit.

12. The downhole system according to claim 8, further comprising a communication unit.

13. The downhole system according to claim 8, wherein the well tubular metal structure comprises two annular barriers, each annular barrier comprising:

a tubular part mounted as part of the first well tubular metal structure, an expandable tubular surrounding the tubular part, each end section of the expandable tubular being connected with the tubular part, an annular barrier space between the tubular part and the expandable tubular, and an expansion opening in the tubular part through which pressurised fluid passes into the annular barrier space for expanding the expandable tubular and bringing the annular barrier from an unexpanded position to an expanded position.

14. The downhole system according to claim 13, wherein the downhole flow device is arranged between the two annular barriers.

15. A downhole manipulation method for shifting a position of a downhole flow device of a downhole system according to claim 8, comprising:

arranging the downhole manipulation tool in engagement with the sliding sleeve, moving the sliding sleeve along the axial extension until the projecting part of the sliding sleeve engages the second groove, and forcing the projecting part out of engagement with the second groove by moving the sliding sleeve further along the axial extension towards engagement with the third groove.

16. The downhole manipulation method according to claim 15, further comprising:

reading the power used by the downhole manipulation tool during movement of the sliding sleeve, and detecting that an increased amount of power is used for verifying that the projecting part has disengaged the second groove.

17. The downhole system for controlling a flow of fluid in a well downhole, comprising:

the downhole device according to claim 1; and a downhole manipulation tool configured to move the sliding sleeve along the axial extension in both upstroke and downstroke directions, the downhole manipulation tool having a projecting unit configured to engage a groove in the sliding sleeve.

* * * * *